US006923182B2

(12) United States Patent
Angadjivand et al.

(10) Patent No.: US 6,923,182 B2
(45) Date of Patent: Aug. 2, 2005

(54) CRUSH RESISTANT FILTERING FACE MASK

(75) Inventors: Seyed Abolhassan Angadjivand, Woodbury, MN (US); James E. Springett, Hudson, WI (US); Thomas I. Insley, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/198,563

(22) Filed: Jul. 18, 2002

(65) Prior Publication Data

US 2004/0011362 A1 Jan. 22, 2004

(51) Int. Cl.[7] ..... A62B 7/10

(52) U.S. Cl. ..... 128/206.19; 128/206.16; 128/205.27; 128/205.29

(58) Field of Search ..... 2/9, 206; 428/36.1, 428/284, 373, 298, 229; 128/206.19, 206.16, 205.29, 205.28, 205.27, 206.21, 206.24, 206.25, 206.13, 206.15, 206.14

(56) References Cited

U.S. PATENT DOCUMENTS

| | | | | |
|---|---|---|---|---|
| 3,220,409 A | | 11/1965 | LiLoia et al. | |
| 3,799,174 A | | 3/1974 | Howard | |
| 4,013,816 A | | 3/1977 | Sabee et al. | |
| 4,215,682 A | | 8/1980 | Kubik et al. | |
| 4,363,682 A | | 12/1982 | Thiebault | |
| RE31,285 E | | 6/1983 | van Turnhout et al. | |
| 4,419,994 A | | 12/1983 | Hilton | |
| 4,536,440 A | * | 8/1985 | Berg | 442/346 |
| 4,547,420 A | | 10/1985 | Krueger et al. | |
| 4,551,378 A | | 11/1985 | Carey, Jr. | |
| 4,588,537 A | | 5/1986 | Klaase et al. | |
| 4,684,570 A | | 8/1987 | Malaney | |
| 4,798,850 A | | 1/1989 | Brown | |
| 4,807,619 A | | 2/1989 | Dyrud et al. | |
| 4,827,924 A | | 5/1989 | Japuntich | |
| 4,850,347 A | | 7/1989 | Skov | |
| 4,873,972 A | | 10/1989 | Magidson et al. | |
| 5,073,436 A | | 12/1991 | Antonacci et al. | |
| 5,114,787 A | | 5/1992 | Chaplin et al. | |
| 5,173,356 A | | 12/1992 | Eaton et al. | |
| 5,225,014 A | | 7/1993 | Ogata et al. | |
| 5,307,796 A | * | 5/1994 | Kronzer et al. | 128/206.16 |
| 5,325,892 A | | 7/1994 | Japuntich et al. | |
| 5,374,458 A | | 12/1994 | Burgio | |

(Continued)

FOREIGN PATENT DOCUMENTS

| | | | | |
|---|---|---|---|---|
| DE | 2161999 A | * | 5/1973 | A41M/43/00 |
| EP | 0 534 863 A1 | | 9/1992 | |
| EP | 0 241 221 B2 | | 12/1993 | |
| EP | 0 416 620 B1 | | 6/1997 | |
| EP | 0 582 286 B1 | | 10/1998 | |
| EP | 1 285 594 A2 | | 2/2003 | |
| GB | 1569812 | | 6/1990 | |
| GB | 2280620 | | 2/1995 | |
| TW | 107298 | | 3/1987 | |
| WO | WO 93/25746 | | 12/1993 | |
| WO | WO 96/09165 | | 3/1996 | |
| WO | WO 96/28216 A | | 9/1996 | |
| WO | WO 97/07272 | | 2/1997 | |
| WO | WO 98/58558 | | 12/1998 | |

*Primary Examiner*—Henry Bennett
*Assistant Examiner*—Andrea M. Ragonese
(74) *Attorney, Agent, or Firm*—Karl G. Hanson

(57) ABSTRACT

A filtering face mask that includes a mask body that is adapted to fit over the nose and mouth of a person and a harness that is attached to the mask body. The mask body comprises i) a first shaping layer that has been molded; ii) a second shaping layer that has been molded; iii) a filtration layer that is disposed between the first and second shaping layers; iv) a first adhesive layer that adheres the first shaping layer to the filtration layer; and v) a second adhesive layer that adheres the second shaping layer to the filtration layer.

20 Claims, 1 Drawing Sheet

U.S. PATENT DOCUMENTS 5,496,507 A 3/1996 Angadjivand et al.
5,558,089 A 9/1996 Castiglione
5,620,785 A 4/1997 Watt et al.
5,656,368 A * 8/1997 Braun et al. ..... 428/141
5,807,796 A 9/1998 Degrand et al.
5,919,847 A * 7/1999 Rousseau et al. ..... 524/89
5,968,635 A 10/1999 Rousseau et al.
5,976,208 A 11/1999 Rousseau et al.
6,002,017 A 12/1999 Rousseau et al.
6,041,782 A * 3/2000 Angadjivand et al. . 128/206.19
6,119,691 A 9/2000 Angadjivand et al.
6,123,077 A 9/2000 Bostock et al.
6,123,752 A 9/2000 Wu et al.
6,214,094 B1 * 4/2001 Rousseau et al. ..... 96/15
6,234,171 B1 5/2001 Springett et al.
6,427,693 B1 * 8/2002 Blackstock et al. .... 128/205.27

* cited by examiner

CRUSH RESISTANT FILTERING FACE MASK

TECHNICAL FIELD

The present invention pertains to a filtering face mask that can demonstrate extraordinarily good crush resistance. The mask includes first and second adhesive layers that are disposed between a filtration layer and first and second shaping layers, respectively.

BACKGROUND

Some respiratory masks are categorized as "disposable" because they are intended to be used for relatively short time periods. These masks are typically made from nonwoven fibrous webs and generally fall into one of two categories, namely, fold-flat masks and shaped masks. Fold-flat masks are packed flat but are formed with seams, pleats, and/or folds that enable them to be opened into a cup-shaped configuration. In contrast, shaped masks are more-or-less permanently formed into a desired face-fitting configuration and generally retain that configuration during use.

Shaped masks regularly include a supporting structure, generally referred to as a "shaping layer", that is commonly made from thermally bonding fibers, which are fibers that bond to adjacent fibers upon being heated and cooled. Examples of face masks that are formed from such fibers are disclosed in U.S. Pat. No. 4,807,619 to Dyrud and U.S. Pat. No. 4,536,440 to Berg. The face masks that are disclosed in these patents comprise a cup-shaped mask body that has at least one shaping layer (sometimes referred to as a "shape retaining layer" or "shell") that supports a filtration layer. Relative to the filtration layer, the shaping layer may reside on an inner portion of the mask (adjacent to the face of the wearer), or it may reside on an outer portion of the mask or on both inner and outer portions. Typically, the filtration layer resides outside the inner shaping layer. Shaping layers also may be made from other materials such as a network or mesh of plastic strands—see, for example, U.S. Pat. No. 4,850,347 to Skov.

In making a mask body for a molded filtering face mask, the filtration layer is typically juxtaposed against at least one shaping layer, and the assembled layers are subjected to a molding operation by, for example, placing the assembled layers between heated male and female mold parts—see U.S. Pat. No. 4,536,440 to Berg. Alternatively, a molded mask body has been made by (1) passing a layer of filtering material and a layer of thermally-bondable fibers together in superimposed relation through a heating stage where the thermally bonded fibers, or at least one component of the fibers is softened, and thereafter (2) molding the superimposed layers to the shape of a face mask in molding members that are a temperature below the softening temperature of the thermally-bonding fibers—see U.S. Pat. No. 5,307,796 to Kronzer et al.

In known commercially available products, the filtration layer, whether made by either of the above-noted techniques, typically becomes attached to the shaping layer by entanglement of the fibers at the interface between the layers and usually also by some binding of the fibers of the shaping layer to the filtration layer—see U.S. Pat. No. 4,807,619 to Dyrud et al. In addition, known masks commonly have a seal about the periphery of the mask body to join the assembled layers together. Although commercially available masks commonly join the filtration layer to the shaping layer as just described, U.S. Pat. No. 6,041,782 to Angadjivand et al. indicates that the filter layer may be bonded to the shaping layer shell across its entire inner surface through use of, for example, an appropriate adhesive.

Although the art recognizes a variety of ways to manufacture molded filtering face masks, it has nonetheless left room for improvement in the construction of such a product. After being worn numerous times and being subjected to high quantities of moisture from a wearer's exhalations, in conjunction with having the mask bump into other objects while being worn on a person's face, known masks can be susceptible to collapsing or having an indentation pressed into the shell. The wearer can remove this indentation by displacing the mask from the face and pressing on the indentation from the mask interior.

SUMMARY OF THE INVENTION

The present invention is directed to providing a filtering face mask that is highly crush resistant to reduce the possibility of having the mask's shape altered from its original configuration because of extended use or rough handling. Since the inventive mask is less likely to have an indentation pressed into its shell, the mask also is less likely to be removed from a wearer's face during use in a contaminated environment, and therefore it presents the benefit of improving a wearer's safety in conjunction with preserving the mask's intended shape so that good filtration performance may be retained throughout the mask's extended life.

In brief summary, the present invention provides a filtering face mask that comprises a) a mask body that is adapted to fit over the nose and mouth of a person and that comprises: i) a first shaping layer that has been molded; ii) a second shaping layer that has been molded; iii) a filtration layer that is disposed between the first and second shaping layers; iv) a first adhesive layer that adheres the first shaping layer to the filtration layer; and v) a second adhesive layer that adheres the second shaping layer to the filtration layer; and b) a harness that is attached to the mask body.

The present invention differs from known filtering face masks in that it has the following sequence of layers in the mask body: a first shaping layer, a first adhesive layer, a filtration layer, a second adhesive layer, and a second shaping layer. The first and second adhesive layers are disposed between the filtration layer and the first and second shaping layers, respectively. Applicants discovered that this combination of shaping layers, adhesive layers, and filtration layer allows a filtering face mask to be provided that can demonstrate extraordinarily good crush resistance while at the same time allowing a filtering face mask to be furnished that is capable of offering a good degree of comfort—in that it is capable of providing a low pressure drop—while also providing good filtration performance and being able to be manufactured in a comparatively simple and cost-effective manner. The improved crush resistance is believed to be the result of tying together structural supporting layers that are separated or spaced by a filtration layer that is disposed therebetween. This creates an "I-beam" effect that furnishes the mask with improved crush resistance.

Filtering face masks of the present invention can be prepared without using a perimeter seal and without using a corrugated pattern in the shell. The mask is held together at the perimeter by the adhesive layers, and the combination of adhered shaping and filtration layers provides sufficient crush resistance, which precludes the need for an additional shape-retaining corrugated structure in the mask body.

These and other advantages of the invention are more fully shown and described in the drawings and detailed description of this invention, where like reference numerals are used to represent similar parts. It is to be understood, however, that the drawings and description are for the purpose of illustration only and should not be read in a manner that would unduly limit the scope of this invention.

GLOSSARY

As used in this document, the following terms are defined as set below:

"Adhesive layer" means a layer of a substance separate from the substances that comprise the filtration and shaping layers, which substance is capable of sticking or joining two components together such as fibers in a filtration layer and the materials that comprise the shaping layer;

"Filtering face mask" means a mask that is capable of removing contaminants from the ambient atmospheric air space when a wearer of the mask inhales;

"Filtration layer" means one or more layers of material, which layer(s) is adapted for the primary purpose of removing contaminants (such as particles) from an air stream that passes through it;

"Harness" means a device or combination of elements that is configured for supporting a mask body on the face of a person;

"Molded" means causing the element being molded, for example, the shaping layer, to take on a predefined form after being subjected to heat and pressure; and "Shaping layer" means a layer that has sufficient structural integrity to retain its desired shape under normal handling.

BRIEF DESCRIPTION OF THE DRAWINGS

By way of example only, embodiments of the invention are described with reference to the accompanying drawings, in which.

DETAILED DESCRIPTION OF PREFERRED EMBODIMENTS

In the practice of the present invention, a new filtering face mask is provided that includes a plurality of layers that operate together to provide a crush-resistant mask that provides good filtration performance.

Figure 1:
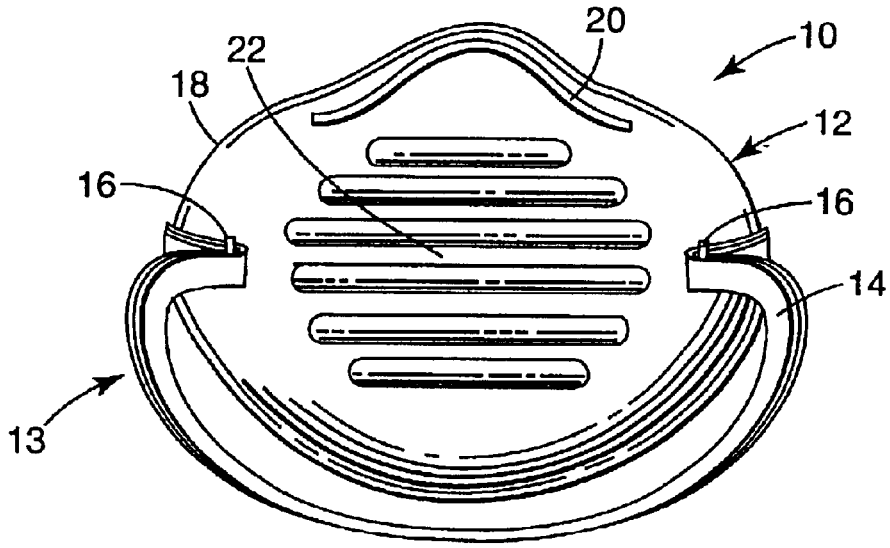
FIG. 1 is a front view of a direct molded respiratory mask 10 in accordance with the present invention.
Figure 2:
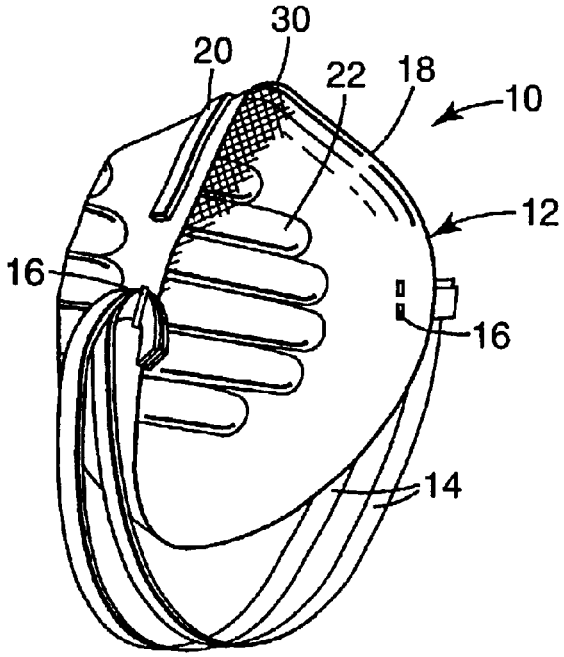
FIG. 2 is a rear perspective view of the mask 10 of FIG. 1.

FIGS. 1 and 2 show an example of a filtering face mask 10 of the invention, which mask 10 comprises a mask body 12 that has a generally cup-shaped, face-fitting configuration and a harness 13 that includes two elastic head bands 14. The elastic bands 14 are stapled 16 to the mask body 12 at each side to hold the mask body 12 against the face of the wearer. Examples of other harnesses that could possibly be used are described in U.S. Pat. No. 5,394,568 to Brostrom et al. and U.S. Pat. No. 5,237,986 to Seppala et al. and in EP 608684A to Brostrom et al. The mask body 12 has a periphery 18 that is shaped to contact the face of the wearer over the bridge of the nose, across and around the cheeks, and under the chin. The mask body 12 forms an enclosed space around the nose and mouth of the wearer and can take on a curved, hemispherical shape as shown in the drawings or it may take on other shapes as so desired. For example, the shaping layer and hence the mask body can have the cup-shaped configuration like the filtering face mask disclosed in U.S. Pat. No. 4,827,924 to Japuntich. In addition, the mask body could be constructed from a plurality of panels that include shaping layers that are molded flat to provide a cup-shaped mask when open and a flat fold mask when closed or folded flat—see, for example, U.S. Pat. No. 6,123,077 to Bostock et al., Des. 431,647 to Henderson et al., and Des. 424,688 to Bryant et al.

A malleable nose clip 20 is secured on the outer face of the mask body 12, centrally adjacent to its upper edge, to enable the mask to be deformed or shaped in this region to properly fit over a particular wearer's nose. An Example of a suitable nose clip is shown and described in U.S. Pat. No. 5,558,089 and Des. 412,573 to Castiglione.

The mask body 12 also may have an optional corrugated pattern 22 that may extend through all or some of the layers of the central region of the mask body 12. Corrugated patterns have been used on known masks to improve their crush resistance. The present invention, however, can enable good crush resistance to be achieved without the need for such a corrugated pattern in the shaping layers of the mask body. The invention thus may eliminate the corrugating process step in the manufacture of filtering face masks without sacrificing the structural integrity of the final product.

Figure 3:
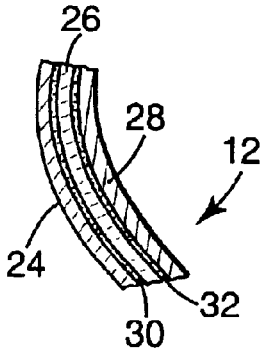
FIG. 3 is a cross section taken through the mask body 12 of FIGS. 1 and 2.

FIG. 3 shows that the mask body 12 may comprise a first shaping layer 24 that has a layer of filter material 26 on its concave (inner) side and, on the inner side of the filter layer 26, a second shaping layer 28 that has the same general shape as the first shaping layer 24. The layer of filter material 26 is adhered to the first and second shaping layers 24 and 28 by first and second adhesive layers 30 and 32, respectively. The adhesive layers 30 and 32 may extend across the entire surface of the shaping layers or may be disposed discontinuously across those layers. The shaping layer's function is primarily to maintain the shape of the mask body 12 and to support the filter layer 26. Although the first shaping layer 24 may also function as a coarse initial filter for air that is drawn into the mask, the predominant filtering action of the mask 10 is provided by the filter layer 26. In addition to the illustrated assembled layers, the mask body 12 could also include a foam seal around the mask perimeter—see, for example, U.S. Pat. No. 4,827,924 to Japuntich—particularly in the nose area 30. Such a seal could include a thermochromic fit-indicating material that contacts the wearer's face when the mask is worn. Heat from the facial contact causes the thermochromic material to change color to allow the wearer to determine if a proper fit has been established—see U.S. Pat. No. 5,617,749 to Springett et al.

Although not illustrated, the mask body could also be provided with inner and outer cover webs to provide improved comfort to the wearer on the inner side of the mask and to trap any fibers that may come loose from the outer shaping layer, respectively. The construction of such a cover web is described below along with descriptions of the shaping, filtration, and adhesive layers.

Shaping Layer

The shaping layers may be formed from at least one layer of fibrous material that can be molded to the desired shape with the use of heat and that retains its shape when cooled. Shape retention is typically achieved by causing the fibers to bond to each other at points of contact between them, for example, by fusion or welding. Any suitable material known for making a shape-retaining layer of a direct-molded respiratory mask may be used to form the mask shell, including, for example, a mixture of synthetic staple fiber, preferably crimped, and bicomponent staple fiber. Bicomponent fiber is a fiber that includes two or more distinct regions of fibrous material, typically distinct regions of polymeric materials. Typical bicomponent fibers include a binder component and a structural component. The binder component allows the fibers of the shape-retaining shell to be bonded together at fiber intersection points when heated and cooled. During heating, the binder component flows into contact with adjacent fibers. The shape-retaining layer can be prepared from fiber mixtures that include staple fiber and bicomponent fiber in a weight-percent ratios that may range, for example, from 0/100 to 75/25. Preferably, the material includes at least 50 weight-percent bicomponent fiber to create a greater number of intersection bonding points, which, in turn, increase the resilience and shape retention of the shell.

Suitable bicomponent fibers that may be used in the shaping layer include, for example, side-by-side configurations, concentric sheath-core configurations, and elliptical sheath-core configurations. One suitable bicomponent fiber is the polyester bicomponent fiber available, under the trade designation "KOSA T254" (12 denier, length 38 mm), from Kosa of Charlotte, N.C., U.S.A., which may be used in combination with a polyester staple fiber, for example, that available from Kosa under the trade designation "T259" (3 denier, length 38 mm) and possibly also a polyethylene terephthalate (PET) fiber, for example, that available from Kosa under the trade designation "T295" (15 denier, length 32 mm). Alternatively, the bicomponent fiber may comprise a generally concentric sheath-core configuration having a core of crystalline PET surrounded by a sheath of a polymer formed from isophthalate and terephthalate ester monomers. The latter polymer is heat softenable at a temperature lower than the core material. Polyester has advantages in that it can contribute to mask resiliency and can absorb less moisture than other fibers.

Alternatively, the shaping layer can be prepared without bicomponent fibers. For example, fibers of a heat-flowable polyester can be included together with staple, preferably crimped, fibers in a shaping layer so that, upon heating of the web material, the binder fibers can melt and flow to a fiber intersection point where it forms a mass, that upon cooling of the binder material, creates a bond at the intersection point. A mesh or net of polymeric strands could also be used in lieu of thermally bondable fibers. An example of this type of a structure is described in U.S. Pat. No. 4,850,347 to Skov.

When a fibrous web is used as the material for the shape-retaining shell, the web can be conveniently prepared on a "Rando Webber" air-laying machine (available from Rando Machine Corporation, Macedon, N.Y.) or a carding machine. The web can be formed from bicomponent fibers or other fibers in conventional staple lengths suitable for such equipment. To obtain a shape-retaining layer that has the required resiliency and shape-retention, the layer preferably has a basis weight of at least about 100 g/m$^2$, although lower basis weights are possible. Higher basis weights, for example, approximately 150 or more than 200 g/m$^2$, may provide greater resistance to deformation and greater resiliency and may be more suitable if the mask body is used to support an exhalation valve. Together with these minimum basis weights, the shaping layer typically has a maximum density of about 0.2 g/cm$^2$ over the central area of the mask. Typically, the shaping layer would have a thickness of about 0.3 to 2.0, more typically about 0.4 to 0.8 millimeters. Examples of shaping layers suitable for use in the present invention are described in the following patents: U.S. Pat. No. 5,307,796 to Kronzer et al., U.S. Pat. No. 4,807,619 to Dyrud et al., and U.S. Pat. No. 4,536,440 to Berg.

Filtration Layer

Filter layers used in a mask body of the invention can be of a particle capture or gas and vapor type. The filter layer may also be a barrier layer that prevents the transfer of liquid from one side of the filter layer to another to prevent, for instance, liquid aerosols or liquid splashes from penetrating the filter layer. Multiple layers of similar or dissimilar filter types may be used to construct the filtration layer of the invention as the application requires. Filters beneficially employed in a laminated mask body of the invention are generally low in pressure drop (for example, less than about 20 to 30 mm $H_2O$ at a face velocity of 13.8 centimeters per second) to minimize the breathing work of the mask wearer. Filtration layers additionally are flexible and have sufficient shear strength so that they do not delaminate under the expected use conditions. Generally the shear strength would be less than that of either the adhesive or shaping layers. Examples of particle capture filters include one or more webs of fine inorganic fibers (such as fiberglass) or polymeric synthetic fibers. Synthetic fiber webs may include electret charged polymeric microfibers that are produced from processes such as meltblowing. Polyolefin microfibers formed from polypropylene that are surface fluorinated and electret charged, to produce non-polarized trapped charges, provide particular utility for particulate capture applications. An alternate filter layer may comprise an adsorbent component for removing hazardous or odorous gases from the breathing air. Adsorbents may include powders or granules that are bound in a filter layer by adhesives, binders, or fibrous structures—see U.S. Pat. No. 3,971,373 to Braun. An absorbent layer can be formed by coating a substrate, such as fibrous or reticulated foam, to form a thin coherent layer. Adsorbent materials such as activated carbons, that are chemically treated or not, porous alumna-silica catalyst substrates, and alumna particles are examples of adsorbents useful in applications of the invention.

The filtration layer is typically chosen to achieve a desired filtering effect and, generally, removes a high percentage of particles or other contaminants from the gaseous stream that passes through it. For fibrous filter layers, the fibers selected depend upon the kind of substance to be filtered and, typically, are chosen so that they do not become bonded together during the molding operation. As indicated, the filter layer may come in a variety of shapes and forms. It typically has a thickness of about 0.2 millimeters to 1 centimeter, more typically about 0.3 millimeters to 1 centimeter, and it could be a planar web coextensive with the shaping layer, or it could be a corrugated web that has an expanded surface area relative to the shaping layer—see, for example, U.S. Pat. Nos. 5,804,295 and 5,656,368 to Braun et al. The filtration layer may also include multiple layers of filter media joined together by an adhesive component. Essentially any suitable material known for forming a filtering layer of a direct-molded respiratory mask may be used for the mask filtering material. Webs of melt-blown fibers, such as taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). Preferably these melt-blown fibers are microfibers that have an effective fiber diameter less than about 20 micrometers ($\mu$m) (referred to as BMF for "blown microfiber"), preferably about 1 to 12 $\mu$m. Effective fiber diameter may be determined according to Davies, C. N., *The Separation Of Airborne Dust Particles,* Institution Of Mechanical Engineers, London, Proceedings 1B, 1952. Particularly preferred are BMF webs that contain fibers formed from polypropylene, poly(4-methyl-1-pentene), or combinations thereof. Electrically charged fibrillated-film fibers as taught in van Turnhout, U.S. Pat. Re. 31,285, may also be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 5,496,507 to Angadjivand et al., by corona charging as disclosed in U.S. Pat. No. 4,588,537 to Klasse et al.; or tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 15 to 100 grams per, square meter. When electrically charged according to techniques described in, for example, the '507 patent, and when including fluorine atoms as mentioned in the Jones et al. patents, the basis weight may be about 20 to 40 g/m$^2$ and about 10 to 30 g/m$^2$, respectively.

Adhesive Layer

Adhesives that tie layers of the mask body together are able to mechanically join the layers while preserving the beneficial air permeability properties of the finished laminate. Suitable adhesives can take many forms and can be of a range of compositions. Regardless of the form or composition, care must be taken in adhesive selection to provide the necessary shear transfer between laminate layers while assuring that the adhesive does not block the interstitial spaces of the finished laminate. Forms of the adhesives include spun filaments, fibrous webs, liquids, powders, and reticulated films. Adhesive webs, powders, or reticulated films are generally layered with filtration layers and other structural and/or cover webs and activated in situ to form the desired laminate. Alternatively, adhesives can be applied in a liquid or molten form to the layers intended to be joined. Molten resins can be sprayed, spun, or printed on layers that are then joined to form the laminate. Water-based adhesives, such as in an emulsion where surfactants are used to disperse and stabilize polymer chains into small particles or solvent-based adhesives can also be applied in a similar manner. Some adhesives may be cured or activated by exposure to heat—however, curing agents or initiators may be required to begin polymerization or crosslinking reactions to cure certain other adhesives. Many adhesives cure by reaction with weak bases or anionic functional groups (water, amines, anhydrides, amides) while others require initiators, such as peroxides, oxygen, ultraviolet light, or radiation such as electron beams. A variety of materials that are useful as adhesives in laminates of the invention, including natural polymeric compounds (starches, dextrins, proteins, and natural rubber), inorganic materials (silicones), and synthetic polymeric materials (thermoplastics, thermosets, elastomers). Thermoplastic hot melt adhesives that are formed into self-supporting webs are particularly useful in applications of the invention.

Hot melt adhesives can form both rigid and flexible bonds and can fill gaps and irregularities between contact points of laminated layers. In order to join layers of the mask body, hot melt adhesives must be able to wet the adjoining surfaces. Some hot melts do not possess good wetting properties and therefore care must be taken in selecting them for applications of the invention. Semicrystalline thermoplastics, especially polyamides and polyesters, are generally used for structural applications. Structural hot melt adhesives should wet the adjoining surfaces in a reasonable amount of time at temperatures that do not compromise other constituents in the laminate structure. Polyamides are useful because they melt rapidly to a low-viscosity fluid. Thermal stability of the melt is low, however, and processing temperatures generally are not much higher than the melting temperature, so that the parts should be rapidly assembled. Polyethylenes may be useful for general purposes, and polysulfones and ethylene-vinyl acetate copolymers can be used for high temperature and low temperature applications, respectively. Polyesters require high temperatures in order to produce a melt with a viscosity that is low enough to adequately wet the adhered surface. Hot melt adhesives are convenient and can be applied rapidly and can provide good resistance to solvents. They also can exhibit high shear strength and moderate peel strength. Because they are not solvent based, they tend to be nontoxic and compatible with respiratory product regulations.

In a preferred embodiment, the adhesive layer is formed from a nonwoven web of fibers that melt when heated. The web preferably has a low basis weight, that is, is less than about 20 grams per square meter (g/m$^2$), more preferably less than 15 g/m$^2$. The arrangement of fibers in the web is preferably uniform, which means that the fibers are substantially evenly distributed throughout the portion of the web that is used to form the adhesive layer. A uniform web may be created using a drilled orifice die. Preferably, the fibers in the uniform web have an effective fiber diameter of about 10 to 50 micrometers. The melting temperature of the fibers should be less than the melting temperature of the materials used in the filtration layer and the shaping layer. For a polypropylene-based filtration layer, the fibers in the adhesive layer preferably have a melting temperature less than about 150° C., more preferably less than 100° C. Generally speaking, the filtration layer is made from materials that exhibit a melting temperature, $T_m$, that is greater than the materials that comprise the shaping layer, which, in turn, have a $T_m$ that is greater than the melting component of the adhesive layer.

Cover Web

An inner cover web could be used to provide a smooth surface that contacts the face of the wearer, and an outer cover web could be used to entrap loose fibers in the outer shaping layer or for aesthetic reasons. A cover web typically does not provide any significant shape retention to the mask body. To obtain a suitable degree of comfort, an inner cover web preferably has a comparatively low basis weight and is formed from comparatively fine fibers. More particularly, the cover web has a basis weight of about 5 to 50 g/m$^2$ (preferably 10 to 30 g/m$^2$), and the fibers are less than 3.5 denier (preferably less than 2 denier, and more preferably less than 1 denier). Fibers used in the cover web preferably have an average fiber diameter of about 5 to 24 micrometers, more preferably, of about 7 to 18 micrometers, and still more preferably of about 8 to 12 micrometers.

The cover web material may be suitable for use in the molding procedure by which the mask body is formed, and to that end, advantageously, has a degree of elasticity (preferably, but not essentially, 100 to 200% at break) or is plastically deformable.

Suitable materials for the cover web are blown microfiber (BMF) materials, particularly polyolefin BMF materials, for example polypropylene BMF materials (including polypropylene blends and also blends of polypropylene and polyethylene). A suitable process for producing BMF materials for the coverweb is described in U.S. Pat. No. 4,013,816 to Sabee et al. Preferably, the web is formed by collecting the fibers on a smooth surface, typically a smooth-surfaced drum. A preferred cover web is made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material after the molding operation without requiring an adhesive between the layers. Particularly preferred materials for the cover web are polyolefin BMF materials that have a basis weight of about 15 to 35 grams per square meter ($g/m^2$) and a fiber denier of about 0.1 to 3.5, and made by a process similar to that described in the '816 patent. Polyolefin materials suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One preferred fiber for the cover web is a polypropylene BMF made from the polypropylene resin "Escorene 3505G" available from Exxon Corporation and having a basis weight of about 25 $g/m^2$ and a fiber denier in the range 0.2 to 3.1 (with an average, measured over 100 fibers of about 0.8).

Another suitable fiber is a polypropylene/polyethylene BMF (produced from a mixture comprising 85 percent of the resin "Escorene 3505G" and 15 percent of the ethylene/alpha-olefin copolymer "Exact 4023" also available from Exxon Corporation) having a basis weight 25 $g/m^2$ and an average fiber denier of about 0.8.

Other suitable materials may include spunbond materials available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the surface of the web after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

Making the Mask Body

A mask body may be made by assembling its various layers together (i.e. the shaping layers, the filter material, and the optional cover web(s), in conjunction with the adhesive layers), placing the assembly between male and female mold parts, and subjecting it to heat and molding pressure. Unheated layered structures may be presented to a thermally regulated warm or hot tool to thereby soften the adhesive materials that form the fiber-to-fiber bonds between layers. The layers are generally compressed (either before or after the softening of the binder material) to form the desired contoured or flat surface of the mask laminate, and optional structural ribs may be incorporated in the molded form to further stiffen the laminate. The amount of heating and compression depends on the materials used in the laminate and the desired properties of the final mask. Further information pertaining to this type of hot-molding process is described in U.S. Pat. No. 4,536,440 to Berg. Another process involves simultaneously thermoforming the stiffening layers, filter layers, and web adhesive layers together after pre-heating. This process includes heating the assembled layers using radiant, conductive, or convective sources, followed by molding in cold tools, or by molding in thermally regulated tools. During the molding of the pre-heated layers, the mold is closed on the heated assembly and is cooled to a temperature less than the melting point of the adhesive materials to thereby set the thermoplastic adhesive materials and form the fiber to fiber bonds. The mold temperature and pressure may depend on the materials used to form the mask body and, in some cases, it may be advantageous to cold mold the mask body by heating the assembled layers before they are fed into the mold, see U.S. Pat. No. 5,307,796 to Kronzer et al.

During the molding process, the shaping layers assume, and thereafter retain, the intended shape of the mask body. At the same time, the filter material, adhesive layers, and cover web(s) are conformed into that particular shape. Conventionally, the mold parts are gapped to allow greater loft generation in the central, generally hemispherical, filtration area of the mask body. In this case, the gapping of the mold parts is chosen to optimize the adhesive bonds and the fiber-to-fiber or filament-to-filament bonding in the shaping layer. After molding, the mask body may be trimmed and, in the case of masks of the type shown in FIGS. 1 and 2, are provided with a mask harness in any conventional or other manner. Using this manufacturing process, the masks of the type shown in FIGS. 1 and 2 do not need to be welded (e.g. by heat or ultrasonic welding) around the mask body periphery.

In one particular embodiment, a filtering face mask may comprise a molded, cup shaped, shape retaining shell that has two shaping layers that surround the filter web. The inside-shaping layer may be made of 100 weight % 4 denier per filament (dpf) bicomponent fiber (based on the weight of fibers in the shaping layer) for very uniform and comfortable surface for wearer. The outer shaping layer may comprise 100 weight % 4 dpf bicomponent fiber based on the weight of the fiber in the layer. Being 100 weight % bicomponent fiber, the chances of having protruding fibers, or fuzz, is significantly reduced. The inner and outer shaping layers may have a basis weight of 50 to 130 grams per square meter ($g/m^2$). This basis weight configuration, and resulting shell stiffness may be further strengthened by the use of 14 to 17 $g/m^2$ non-woven adhesive web made by Bostik Findley, Middleton, Mass., USA. By using these non-woven adhesive layers in-between the filter and shaping layer (both sides of the filter, in-between the shaping layer), the laminate when molded acts like an "I beam", wherein, the new structure is such that the mask body is highly collapse resistant. Shells molded with an adhesive layer may be more than 30% and even more than 40% stiffer than mask bodies that have no adhesive layer. The masks also may not as susceptible to delamination at the periphery. Because of these features, the basis weight of the inner shaping layer can be reduced, which may improve wearer comfort. The elimination of the perimeter seal and the elimination of the need for a corrugated, crush-resistant pattern, may save manufacturing costs and may avoid compaction of the filter element in that area. An ultrasonic welding step to seal the perimeter edge also can be eliminated, which also can reduce processing costs during manufacture. Further, the mask may be more comfortable to a wearer without a stiff perimeter.

The following Examples have been selected merely to further illustrate features, advantages, and other details of the invention. It is to be expressly understood, however, that while the Examples serve this purpose, the particular ingredients and amounts used as well as other conditions and details are not to be construed in a manner that would unduly limit the scope of this invention.

EXAMPLES

Test Methods

The following test methods were used to evaluate the webs and molded filter elements:

Particulate Penetration with Sodium Chloride

Penetration and pressure drop for individual molded filter was determined using an AFT Tester, Model 8130, from TSI Incorporated, St. Paul, Minn. Sodium Chloride (NaCl) at a concentration of 20 milligrams per cubic meter ($mg/m^3$) was used as a challenge aerosol. The aerosol challenges were delivered at a face velocity of 13.8 centimeters per second (cm/sec). Pressure drop over the molded filter specimen was measured during the penetration test and is reported in millimeters water (mm $H_2O$).

Molded Article Stiffness Determination Test Method

Stiffness of a molded filter element was measured using a King Stiffness Tester, available from Jaking & Co., Greensboro, N.C. Stiffness is determined as the force required to push a 2.54 cm-diameter, flat-faced, probe 8.06 cm (3.175 inches) depthwise into the filter element. The probe element was placed outside of the filter element and was oriented perpendicular to the platform onto which the filter element is placed for testing. For a molded filtering facemask, the facemask is placed on a platform with the convex side of the mask facing towards, and centered under, the probe. The probe was then descended towards the mask at a rate of 32 mm/sec, contacting the facemask and compressing it to the specified extent (21 millimeters). At the end of the full descention of the probe, the force (in Newtons) required to compress the article was recorded.

Quality Factor ($Q_F$)

Quality factor is determined as follows:

The penetration and pressure drop are used to calculate a quality factor "$Q_F$ value" from the natural log (Ln) of the NaCl penetration by the following formula:

$$Q_F(1/\text{mm } H_2O) = -\text{Ln}\{\text{NaCl Penetration } (\%)/100\}/\text{Pressure Drop } (\text{mm } H_2O)$$

A higher initial $Q_F$ value indicates better initial filtration performance. Decreased $Q_F$ values effectively correlate with decreased filtration performance.

Example 1

A cup-shaped mask of the invention was prepared by first layering shaping, tie, and filter materials together in a S•A•F•A•S sequence where S represents a shaping layer, A represents an adhesive layer, and F represents a filtration layer. The material for the shaping layer was a thermal bonding staple fiber [T-254, 4 denier, by 38 mm cut length, composition PET core, COPET Sheath] available from Kosa, Charlotte, N.C. The fibers for the shaping layer were formed into a web at a basis weight of 63 $g/m^2$ inner and outer layers using an air Rando Webber. The adhesive layer was a nonwoven adhesive web PE-85-12 available from Bostik Findley, Middleton, Mass. The filter web had a basis weight of 35 grams per square meter, fiber size of 4.7 $\mu$m effective fiber diameter (EFD), as calculated according to the method set forth in Davis, C. N., *The Separation Of Airborne Dust Particles,* Institution Of Mechanical Engineers, London, Proceedings 1B, 1952, 0.50 millimeters (mm) thickness. The blown microfiber web was made from polypropylene Fina 3960 (from Fina Oil and Chemical Co., Houston, Tex.) and was corona treated and hydrocharged as described in the '507 patent to Angadjivand et al. The weight ratio of the components used in the blown microfiber component were 98.5% polypropylene, and 1.5% Green pigment. Green pigment supplied by AmeriChem, Concord, N.C. Molding of the layered web was done by pressing the assembled layers between mating female and male molds. The female mold had a height of about 55 mm and had a volume of 310 $cm^3$. In this hot molding method, the top and bottom half of the mold were heated to about 105° C., and the webs were placed between the mold halves. The heated mold was then closed at a gap of 1.27 to 2.29 mm, for approximately 10 to 15 seconds dwell time. After the specified time, the mold was opened and the molded product was removed. The molded cup-shaped mask was evaluated for crush resistance and particle penetration. Test results are given in Table 1. Initial penetration, and pressure drop of the molded face mask were measured using the AFT 8130, particle penetration test. Stiffness of the element was measured by the Molded Article Stiffness Determination Test Method. The test results are set forth in Table 1 below.

Comparative Example 1

A comparative mask was prepared and tested in the manner as described in Example 1 except that no adhesive layers were used in the construction. Test results are given in Table 1.

TABLE 1

| Example | Stiffness (N) | Pressure Drop (mm $H_2O$) | Penetration (%) | Q Factor |
|---|---|---|---|---|
| E1 | 4.3 | 8 | 0.23 | 0.74 |
| C1 | 2.9 | 7 | 0.26 | 0.88 |

The data demonstrate that an improvement in stiffness without substantial reduction in respiratory performance may be achieved by a product of the invention over the same product without the inventive construction. This data also illustrates that by using the beam-strengthening effect of the laminated inventive mask body, a 48% increase in stiffness and corresponding shape memory can be attained with comparative values in pressure drop, penetration, or quality factor.

This invention may take on various modifications and alterations without departing from the spirit and scope thereof. Accordingly, it is to be understood that this invention is not to be limited to the above-described, but it is to be controlled by the limitations set forth in the following claims and any equivalents thereof. It is also to be understood that this invention may be suitably practiced in the absence of any element not specifically disclosed herein.

What is claimed is:

1. A filtering face mask that comprises:

a) a mask body that is adapted to fit over the nose and mouth of a person and that comprises:

i) a first shaping layer that has been molded;

ii) a second shaping layer that has been molded;

iii) a filtration layer that is disposed between the first and second shaping layers;

iv) a first adhesive layer that adheres the first shaping layer to the filtration layer; and v) a second adhesive layer that adheres the second shaping layer to the filtration layer; and b) a harness that is attached to the mask body.

2. The filtering face mask of claim 1, wherein the first and second shaping layers are molded into a cup-shaped configuration.

3. The filtering face mask of claim 1, wherein the first and second adhesive layer are made from fibers.

4. The filtering face mask of claim 3, wherein the first and second adhesive layer are made from a web of fibers, which web has a basis weight less than about 20 grams per square meter.

5. The filtering face mask of claim 3, wherein the adhesive layer is made from a web of fibers, which web has a basis weight less than about 15 grams per square meter.

6. The filtering face mask of claim 4, wherein the first and second adhesive layer are made from fibers that have an effective fiber diameter of about 10 to 50 micrometers.

7. The filtering face mask of claim 1, wherein the filtration layer contains materials that exhibit a melting temperature that is greater than the melting temperature of bonding components in the shaping layer, which bonding components in the shaping layer have a melting temperature greater than a melting component(s) of the first and second adhesive layer.

8. The filtering face mask of claim 1, wherein the first and second shaping layers have a basis weight of 50 to 130 grams per square meter.

9. The filtering face mask of claim 1, wherein the first shaping layer has a basis weight that is about the same as the basis weight of the second shaping layer.

10. The filtering face mask of claim 1, wherein the mask body exhibits a stiffness that is at least 30 percent greater than the stiffness of a mask body of the same construction but does not comprise the first and second adhesive layers.

11. The filtering face mask of claim 1, wherein the mask body exhibits a stiffness that is at least 40 percent greater than the stiffness of a mask body of the same construction but does not comprise the first and second adhesive layers.

12. The filtering face mask of claim 1, wherein the first and second shaping layers include bicomponent fibers.

13. The filtering face mask of claim 1, wherein the first and second shaping layers include at least 50 weight percent bicomponent fibers.

14. The filtering face mask of claim 1, wherein the filtration layer comprises meltblown polymeric microfibers that have been electrically charged.

15. The filtering face mask of claim 14, wherein the meltblown microfibers comprise polypropylene, poly(4-methyl-1-pentene) or combinations thereof.

16. The filtering face mask of claim 15, wherein the microfibers have been electrically charge by corona charging, hydrocharging, or a combination thereof.

17. The filtering face mask of claim 16, wherein the meltblown microfibers have fluorine atoms located on the surface of the fibers.

18. The filtering face mask of claim 17, wherein the filtration layer has a basis weight of about 20 to 30 grams per square meter.

19. The filtering face mask of claim 1, wherein the mask body has been made by a cold molding process.

20. A mask body that comprises:

i) a first shaping layer that has been molded;

ii) a second shaping layer that has been molded;

iii) a filtration layer that is disposed between the first and second shaping layers;

iv) a first adhesive layer that adheres the first shaping layer to the filtration layer; and v) a second adhesive layer that adheres the second shaping layer to the filtration layer.

* * * * *

UNITED STATES PATENT AND TRADEMARK OFFICE

CERTIFICATE OF CORRECTION

PATENT NO. : 6,923,182 B2
DATED : August 2, 2005
INVENTOR(S) : Angadjivand et al.

It is certified that error appears in the above-identified patent and that said Letters Patent is hereby corrected as shown below:

Column 7,
Line 22, after "per" delete ",".

Column 13,
Lines 2, 4, 11 and 19, delete "layer" and insert -- layers -- therefore.

Column 14,
Line 13, delete "charge" and insert -- charged -- therefore.

Signed and Sealed this

Eleventh Day of October, 2005

JON W. DUDAS
*Director of the United States Patent and Trademark Office*